US008125204B2

(12) United States Patent
Liu et al.

(10) Patent No.: US 8,125,204 B2
(45) Date of Patent: Feb. 28, 2012

(54) TWO-STAGE POWER SUPPLY WITH FEEDBACK ADJUSTED POWER SUPPLY REJECTION RATIO

(75) Inventors: Jing-Meng Liu, Jubei (TW); Chung-Lung Pai, Taipei (TW); Wei-Che Chiu, Hsin-Chu (TW)

(73) Assignee: Richtek Technology Corporation, Hsin-Chu (TW)

( * ) Notice: Subject to any disclaimer, the term of this patent is extended or adjusted under 35 U.S.C. 154(b) by 783 days.

(21) Appl. No.: 12/008,272

(22) Filed: Jan. 10, 2008

(65) Prior Publication Data

US 2008/0180073 A1 Jul. 31, 2008

(30) Foreign Application Priority Data

Jan. 29, 2007 (TW) ..... 96103165 A

(51) Int. Cl.
*G05F 1/00* (2006.01)

(52) U.S. Cl. ..... 323/274; 323/284

(58) Field of Classification Search ..... 323/273, 323/266–268, 284–285
See application file for complete search history.

(56) References Cited

U.S. PATENT DOCUMENTS

| | | | | |
|---|---|---|---|---|
| 5,592,072 | A * | 1/1997 | Brown | 323/268 |
| 6,229,289 | B1 * | 5/2001 | Piovaccari et al. | 323/268 |
| 6,388,259 | B1 * | 5/2002 | Murdock | 250/370.01 |
| 6,815,935 | B2 * | 11/2004 | Fujii | 323/272 |
| 6,850,044 | B2 * | 2/2005 | Hansen et al. | 323/266 |
| 7,084,612 | B2 * | 8/2006 | Zinn | 323/266 |
| 7,282,895 | B2 * | 10/2007 | Thiele et al. | 323/266 |
| 7,436,159 | B1 * | 10/2008 | Wochele | 323/273 |
| 7,489,118 | B2 * | 2/2009 | Fujii | 323/268 |
| 2002/0171403 | A1 * | 11/2002 | Lopata | 323/280 |
| 2004/0027099 | A1 * | 2/2004 | Fujii | 323/234 |
| 2004/0178776 | A1 * | 9/2004 | Hansen et al. | 323/266 |
| 2006/0261790 | A1 * | 11/2006 | Tai et al. | 323/274 |
| 2007/0290657 | A1 * | 12/2007 | Cretella et al. | 323/222 |

OTHER PUBLICATIONS

IBM, "Load Compensated Voltage Regulator", Oct. 1970, IBM Technical Disclosure Bulletin, vol. 13, pp. 1110-1111.*

* cited by examiner

*Primary Examiner* — Adolf Berhane
*Assistant Examiner* — Jeffrey Gblende
(74) *Attorney, Agent, or Firm* — Tung & Associates

(57) ABSTRACT

The present invention discloses a power supply comprising: a switching regulator circuit converting an input voltage to an intermediate voltage; a low dropout linear regulator circuit converting the intermediate voltage to an output voltage so as to supply a load current to a load; and a feedback control circuit which increases the noise filtering effect of the low dropout linear regulator circuit when the load current increases.

3 Claims, 10 Drawing Sheets

TWO-STAGE POWER SUPPLY WITH FEEDBACK ADJUSTED POWER SUPPLY REJECTION RATIO

FIELD OF INVENTION

The present invention relates to a power supply with high efficiency and low noise, in particular to a power supply comprising a first stage switching regulator and a second stage low dropout linear regulator (LDO) circuit; the power supply is capable of dynamically adjusting the power conversion ratios of the two stages so that the power conversion efficiency and the noise of the overall circuit are balanced at an optimum. The present invention also proposes a corresponding method.

BACKGROUND OF THE INVENTION

In general, a switching regulator has better power conversion efficiency, while an LDO circuit provides lower noise in its output. Therefore, as shown in FIG. 1, a power supply combining both has been proposed which first converts an input voltage Vin to an intermediate voltage Vm, and next converts the intermediate voltage Vm to an output voltage Vout. The switching regulator (SR) 10 provides a first stage high-efficiency conversion, while the LDO circuit (LDO) 20 filters the ripple noise in the intermediate voltage Vm. Naturally, in this arrangement, the intermediate voltage Vm is conventionally designed to be as close to the output voltage Vout as possible, so that most power conversion is achieved in the first stage switching regulator, for better power conversion efficiency.

The capability of an LDO circuit to filter the ripple noise is referred to as the "power supply rejection ratio", PSRR. PSRR is relevant to three factors: the voltage drop from an input of an LDO circuit to its output (referred to as the "dropout voltage" in this invention); the load current at its output; and the quiescent current of the LDO circuit. The higher the dropout voltage, the better the PSRR; the higher the load current, the worse the PSRR; the higher the quiescent current, the better the PSRR. However, apparently, to increase the dropout voltage or the quiescent current will decrease the power conversion efficiency.

Conventionally, there is no "adaptive" design in this kind of power supply, namely to vary the power conversion ratios of the two stages according to the load condition all prior art circuits follow a simple logic: to set the voltage drop between the intermediate voltage Vm and the output voltage Vout to a constant as low as possible, that is, to set the output of the first stage switching regulator to a fixed voltage as close to the output voltage Vout as possible. The corresponding circuit is simple, and has high power conversion efficiency, but if the load circuit receiving the supplied power is sensitive to noises, such prior art circuits can not meet the expectation required by the load circuit.

More specifically, referring to schematic diagram of FIG. 2 wherein the horizontal coordinate is the load current and the vertical coordinate is the magnitude, it can be seen that as the load current (output current) increases, the noise in the intermediate voltage Vm also increases, and the PSRR of the LDO circuit decreases. The overall effect is shown by the third curve, that the overall noise of the output voltage Vout increases along with the increase of the load current.

In view of the above, it is desired to provide a power supply capable of dynamically controlling the power conversion efficiency and the overall noise, so that they are balanced at an optimum according to the requirement from the load circuit.

SUMMARY

Hence, it is an objective of the present invention to provide a power supply capable of balancing the power conversion efficiency and the overall noise at an optimum.

Another objective of the present invention is to provide a power conversion method for use in a power supply.

In accordance with the foregoing and other objectives of the present invention, and from one aspect of the present invention, a power supply comprises: a switching regulator circuit converting an input voltage to an intermediate voltage; a low dropout linear regulator circuit converting the intermediate voltage to an output voltage so as to supply a load current to a load; and a feedback control circuit which increases the noise filtering effect of the low dropout linear regulator circuit when the load current increases.

In the power supply of the present invention, preferably, the feedback control circuit either increases the voltage drop between the intermediate voltage and the output voltage, or increases the quiescent current of the low dropout linear regulator circuit.

According to another aspect of the present invention, a power conversion method comprises the steps of: (A) providing a switching regulator circuit for converting an input voltage to an intermediate voltage; (B) providing a low dropout linear regulator circuit for converting the intermediate voltage to an output voltage so as to provide a load current to a load; and (C) adjusting the noise filtering effect of the low dropout linear regulator circuit so that it increases when the load current increases.

In the power conversion method of the present invention, preferably, a signal relating to the noise filtering effect of the low dropout linear regulator circuit includes one or more of the followings: the gate voltage signal of the power transistor, the gate to source voltage signal of the power transistor, the gate to drain voltage signal of the power transistor, the output voltage signal of the error amplifier, the load current signal, and a signal showing an abnormal condition of the load.

It is to be understood that both the foregoing general description and the following detailed description are provided as examples, for illustration rather than limiting the scope of the invention.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
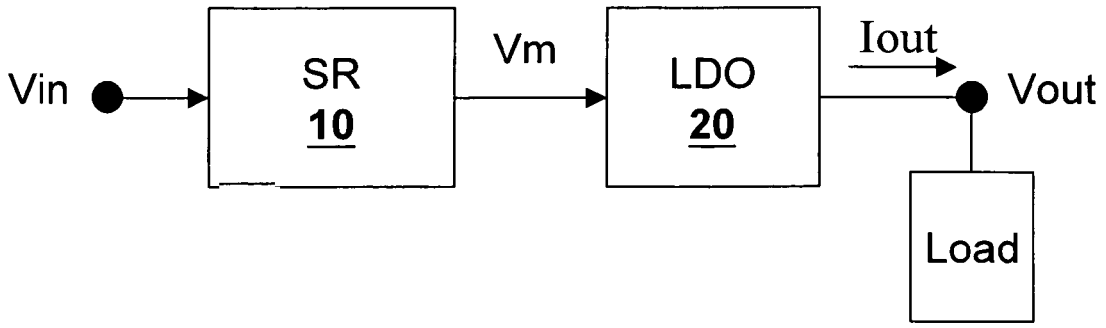
Fig. 1 (Prior Art)
FIG. 1 is a schematic diagram showing a conventional power supply.
Figure 2:
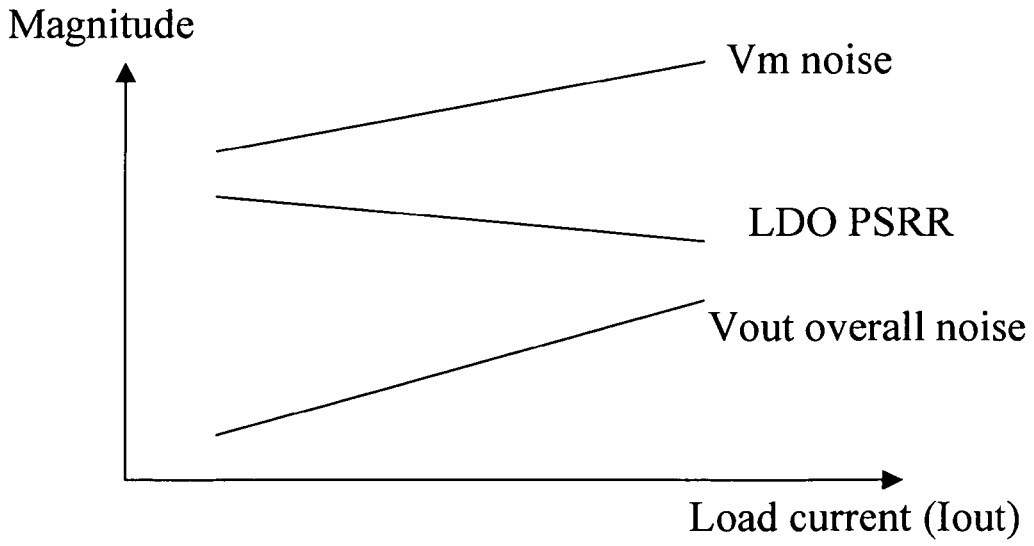
Fig. 2 (Prior Art)
FIG. 2 explains the drawback of the conventional power supply.
Figure 3A:
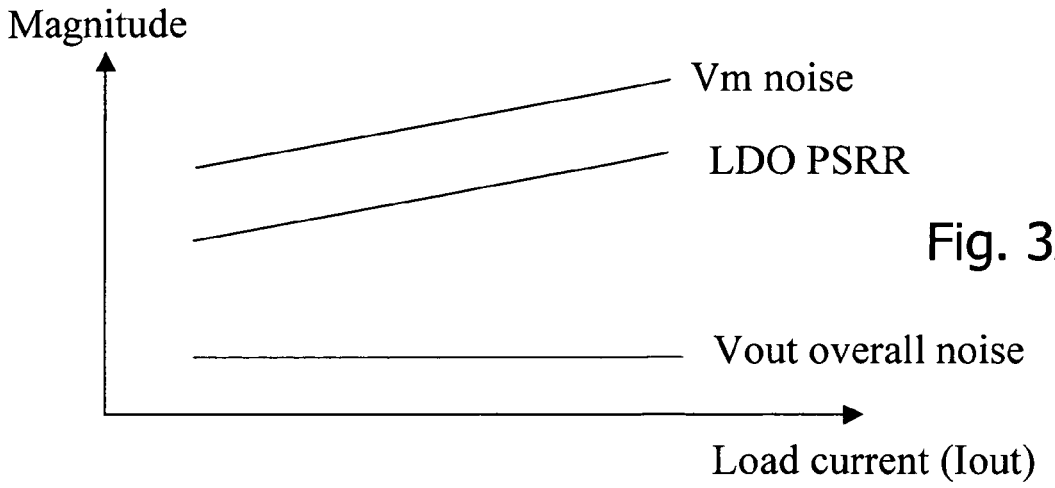
FIGS. 3A-3C explain the principle of the present invention.
Figure 3B:
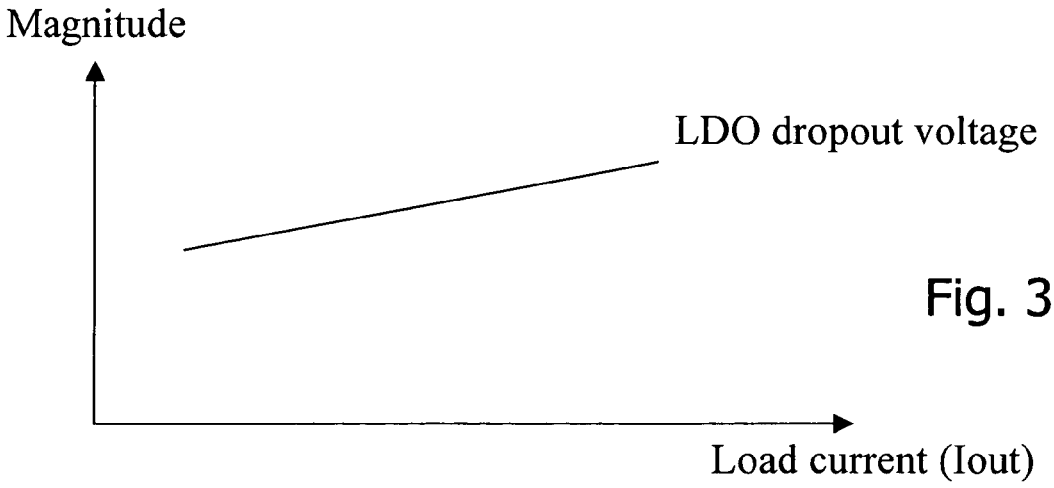
Figure 3C:
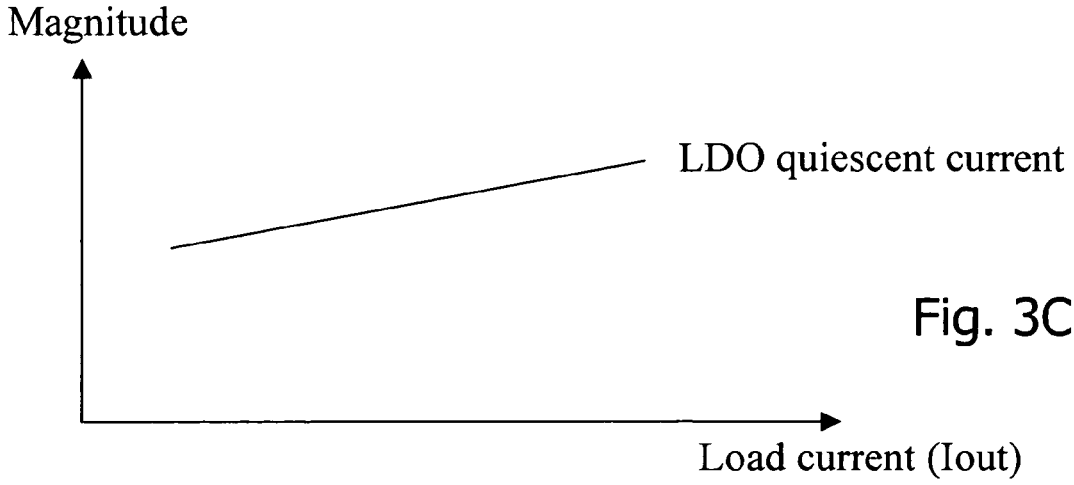

First, the principle of the present invention will be explained with reference to FIGS. 3A-3C. Referring to FIG. 3A which is a schematic diagram showing the concept of the present invention, when the load current increases, if the PSRR of the LDO circuit is correspondingly increased, the noise in the output voltage can be controlled within a range acceptable by the load circuit. (Note that the curves are symbolic; they are not necessarily straight lines, and the overall noise in the output voltage Vout does not have to be kept as a constant.) FIG. 3B shows one approach to achieve the goal of FIG. 3A, wherein the dropout voltage of the LDO circuit increases as the load current increases. FIG. 3C shows another approach to achieve the goal of FIG. 3A, wherein the quiescent current Icc of the LDO circuit increases as the load current increases. One or both of the approaches, or other ways can be taken to adjust the PSRR of the LDO circuit, as long as such ways can keep the overall noise in an acceptable range.

Figure 4:
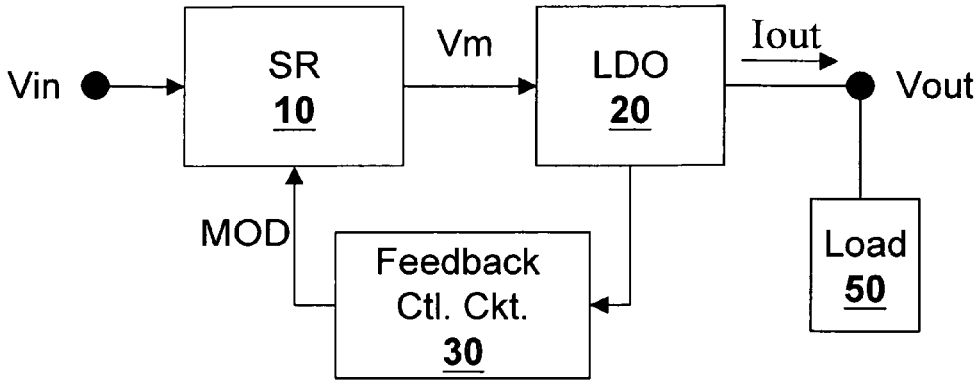
FIG. 4 is a schematic diagram showing an embodiment of the present invention.
Figure 5A:
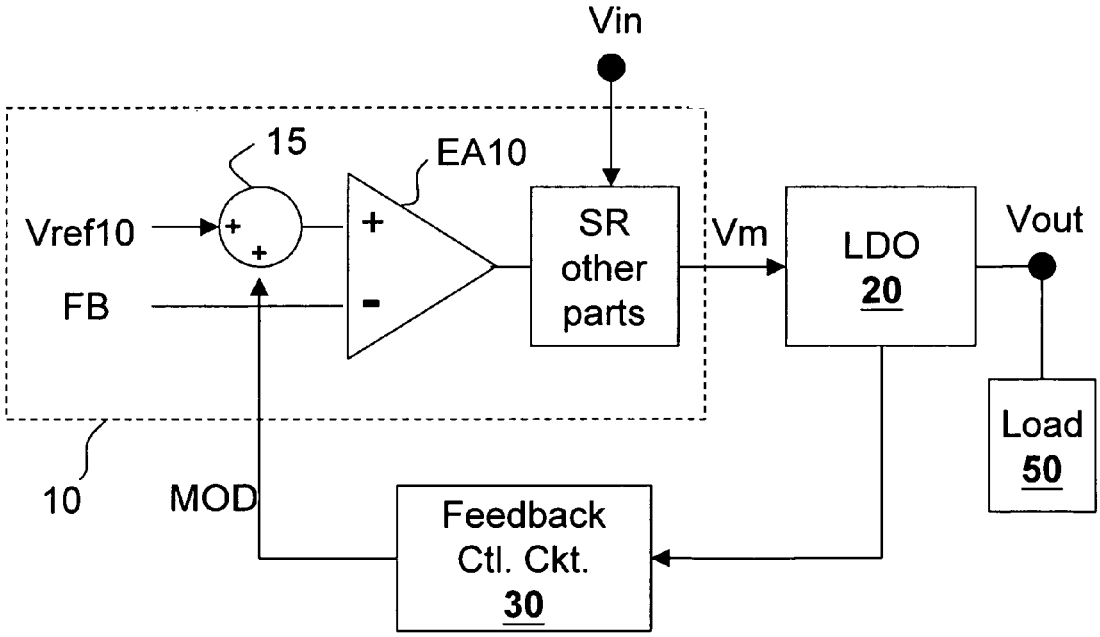
FIGS. 5A and 5B show two examples to control the switching regulator according to the modulation signal MOD.
Figure 5B:
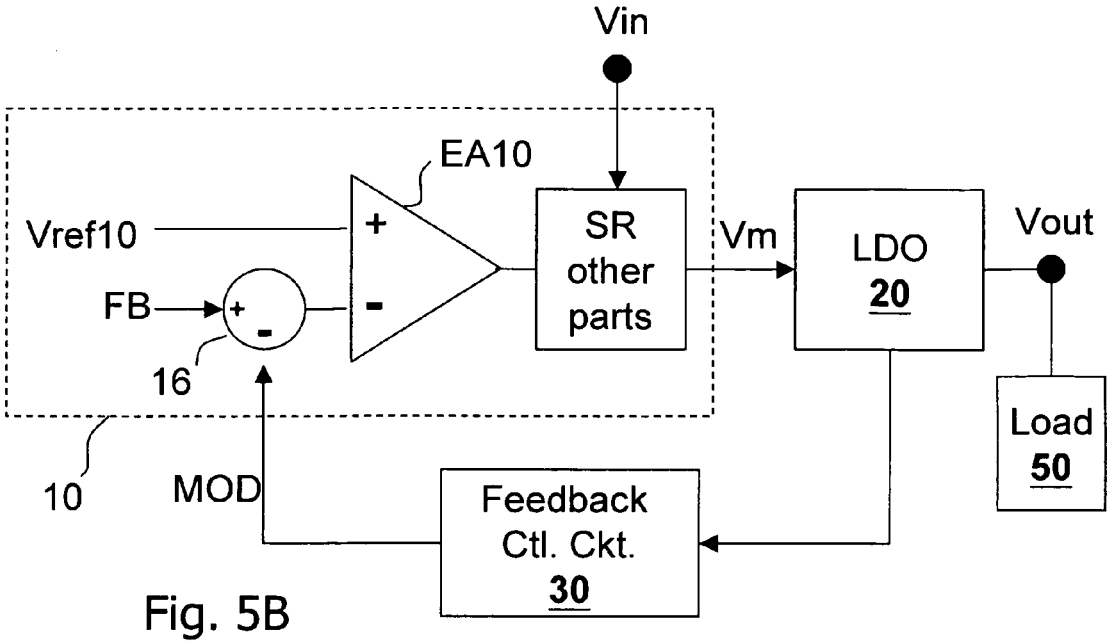

FIG. 4 shows a schematic diagram of one embodiment according to the present invention. As shown in the figure, the circuit includes a feedback control circuit 30 which generates a modulation signal MOD according to an internal signal of the LDO circuit 20 (as shown) or an external signal (not shown; to be further explained in conjunction with FIGS. 14A and 14B), to adjust the output of a first stage switching regulator 10. The output of the switching regulator 10 can be adjusted in many ways, such as: by adjusting the inputs to an error amplifier EA10 inside the switching regulator 10, as shown in FIGS. 5A and 5B, or by adjusting an input offset voltage of the error amplifier EA10, etc. The circuit structure of a switching regulator is not illustrated in detail because it has been well known. Under the teachings of the present invention, those skilled in this art can think of many ways to adjust the output of the switching regulator 10 according to the modulation signal MOD, which should all belong to the scope of the present invention. The key is to adjust the output of the switching regulator 10 so that the intermediate voltage Vm changes according to the modulation signal MOD, and thereby the dropout voltage of the second stage LDO circuit 20 changes, to correspondingly adjust the PSRR of the LDO circuit 20.

There are many ways to embody the summation circuits 15 and 16 shown in FIGS. 5*a* and 5B, which are not illustrated in detail here because they are well known by those skilled in this art. As an example, two input voltages can be converted to currents, and one is added to or subtracted from the other; the resultant current can be converted back to a voltage, which is the sum or difference of the two input voltages.

There are many ways to embody the feedback control circuit 30 for generating the modulation signal MOD. The modulation signal MOD can be generated according to the load current, the internal signal of the LDO circuit 20, or any signal relating to the PSRR of the LDO circuit 20. Several embodiments will be provided below; note that they are for illustration rather than limiting the scope of the invention. Those skilled in this art can think of many variations without departing from the spirit of the present invention.

Figure 6:
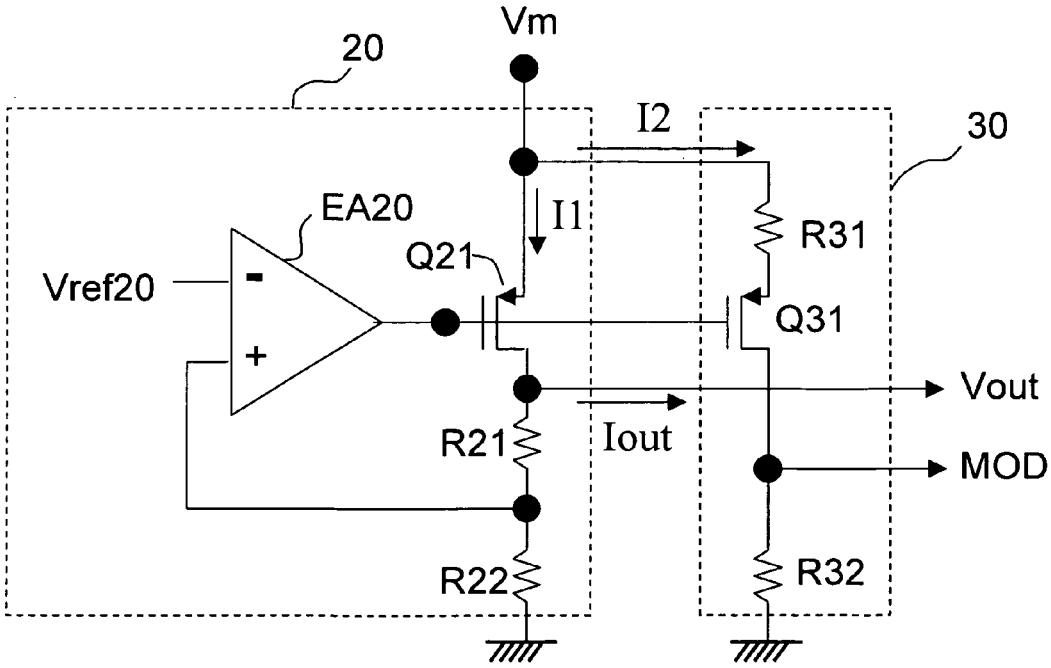
FIGS. 6-8 show three embodiments of the feedback control circuit, corresponding to the case wherein the power transistor of the low dropout linear regulator circuit is a PMOS transistor.

A first embodiment of the feedback control circuit 30 is shown in FIG. 6. The LDO circuit 20 at the left side of the figure includes a PMOS transistor as its output power transistor. The feedback control circuit 30 of the present invention is located at the right side of the figure. By properly arranging the resistances of the resistors R21, R22, R31, and R32, and the matching between the transistors Q21 and Q31, the current I1 can be kept far larger than the current I2, so the feedback control circuit 30 does not consume significant amount of power. The current I2 passing through the transistor Q31 is equal to (Vgs21−Vgs31)/R31, where Vgs21 is the gate to source voltage of the transistor Q21 and Vgs31 is the gate to source voltage of the transistor Q31. The current I2 is small, so Vgs31 is about equal to the conduction threshold voltage Vth31 of the transistor Q31, and thus the current I2 is about equal to (Vgs21−Vth31)/R31; hence, the modulation signal MOD (in this case, an analog voltage signal) has a voltage value of $$R32*I2=R32(Vgs21-Vth31)/R31$$

wherein Vth31, R31 and R32 are constants, and therefore the modulation signal MOD is a function of Vgs21, and because load current Iout is about equal to I1, the modulation signal MOD is a function of the load current.

Figure 7:
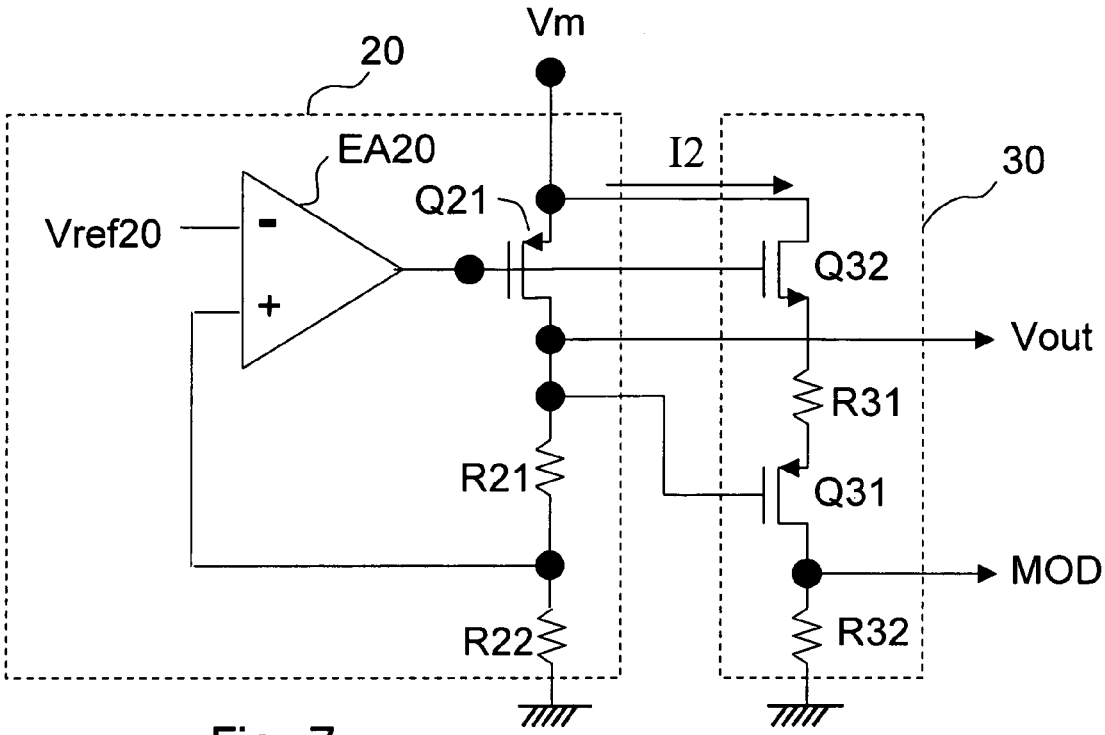

FIG. 7 shows a second embodiment of the feedback control circuit 30, which is different from the previous embodiment in that the modulation signal MOD is a function of the gate to drain voltage Vgd21 of the transistor Q21. Similar to the above, the current I2 is small, so Vgs31 is about equal to the conduction threshold voltage Vth31 of the transistor Q31, and Vgs32 is about equal to the conduction threshold voltage Vth32 of the NMOS transistor Q32. The gate of the PMOS transistor Q31 is connected to the drain of the transistor Q21, so the current I2 is about equal to (Vgd21−Vth31−Vth32)/R31, and the modulation signal MOD (in this case, also an analog voltage signal) has a voltage value of $$R32*I2=R32(Vgd21-Vth31-Vth32)/R31$$

wherein Vth31, Vth32, R31 and R32 are constants, and therefore the modulation signal MOD is a function of Vgd21.

Figure 8:
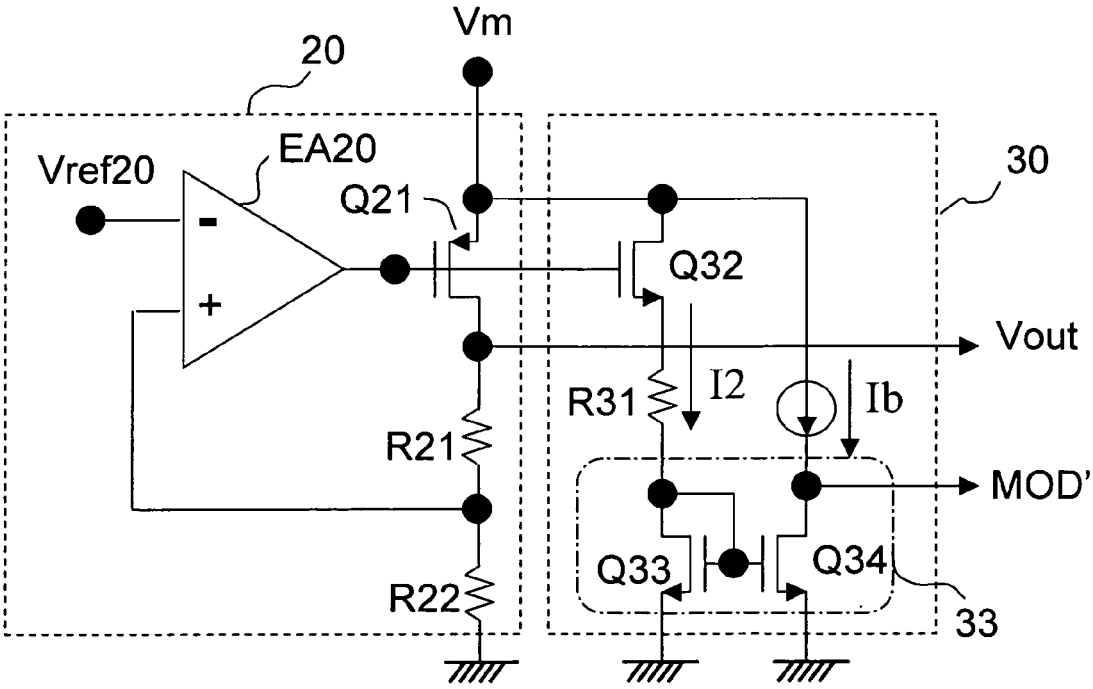

FIG. 8 shows a third embodiment of the feedback control circuit 30; in this case, the modulation signal MOD' is a digital signal. The digital modulation signal MOD' may be applied such as in the case where the load circuit has only two operation modes, and the intermediate voltage Vm only needs to change between two states. In this case it is not required to provide a continuous analog modulation signal MOD, but only a digital modulation signal MOD' which switches between two states. The modulation signal MOD' is supplied to the switching regulator 10 in a manner different from the one shown in FIGS. 5A and 5B, to adjust the intermediate voltage Vm.

In this embodiment, at the level switching point of the modulation signal MOD', I2=Ib, and the voltage across the resistor R31 is equal to Ib*R31. If the current mirror 33 functions normally, it means that both the NMOS transistor Q32 and the NMOS transistor Q33 are conductive, and the gate voltage Vg21 of the transistor Q21 (i.e., the output of the error amplifier EA20) is equal to (Vth32+Ib*R31+Vth33). At this point, if Vg21 increases, since the current passing through the NMOS transistor Q34 increases, the modulation signal MOD' drops to low level. On the contrary, if Vg21 is smaller than (Vth32+Ib*R31+Vth33), since the current passing through the NMOS transistor Q34 is smaller than Ib, the modulation signal MOD' goes up to high level. Because Vth32, Ib, R31, and Vth33 are all constants, the level of the modulation signal MOD' depends on the gate voltage Vg21 of the transistor Q21:

$$MOD'=H, \text{ when } Vg21<(Vth32+Ib*R31+Vth33)$$

$$MOD'=L, \text{ when } Vg21>(Vth32+Ib*R31+Vth33)$$

Figure 9A:
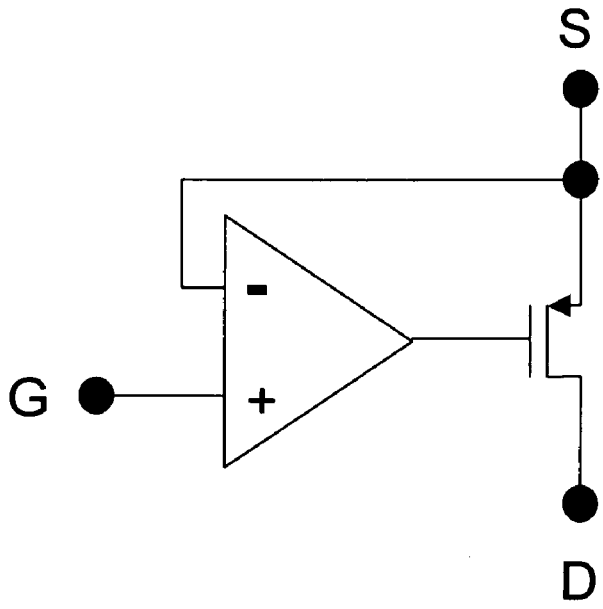
FIGS. 9A and 9B show alternatives to the devices of FIGS. 6-8.
Figure 9B:
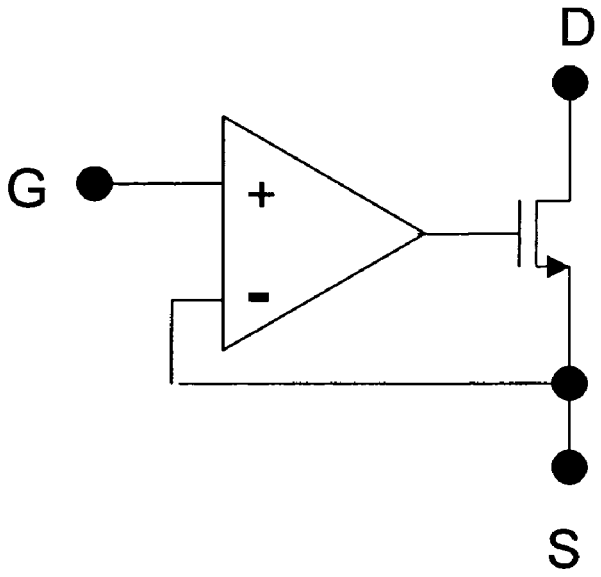

The source followers in the above three embodiments (the transistor Q31 in FIG. 6 and the transistor Q32 in FIGS. 7 and 8) may be replaced by one of the circuits as shown in FIGS. 9A and 9B, to set the conduction threshold of the transistor to zero to further simplify the functional equations. In FIGS. 9A and 9B, the nodes G, S and D replace the gate, source and drain of the transistor Q31 or Q32, for connection with corresponding nodes in the original circuits.

Figure 10:
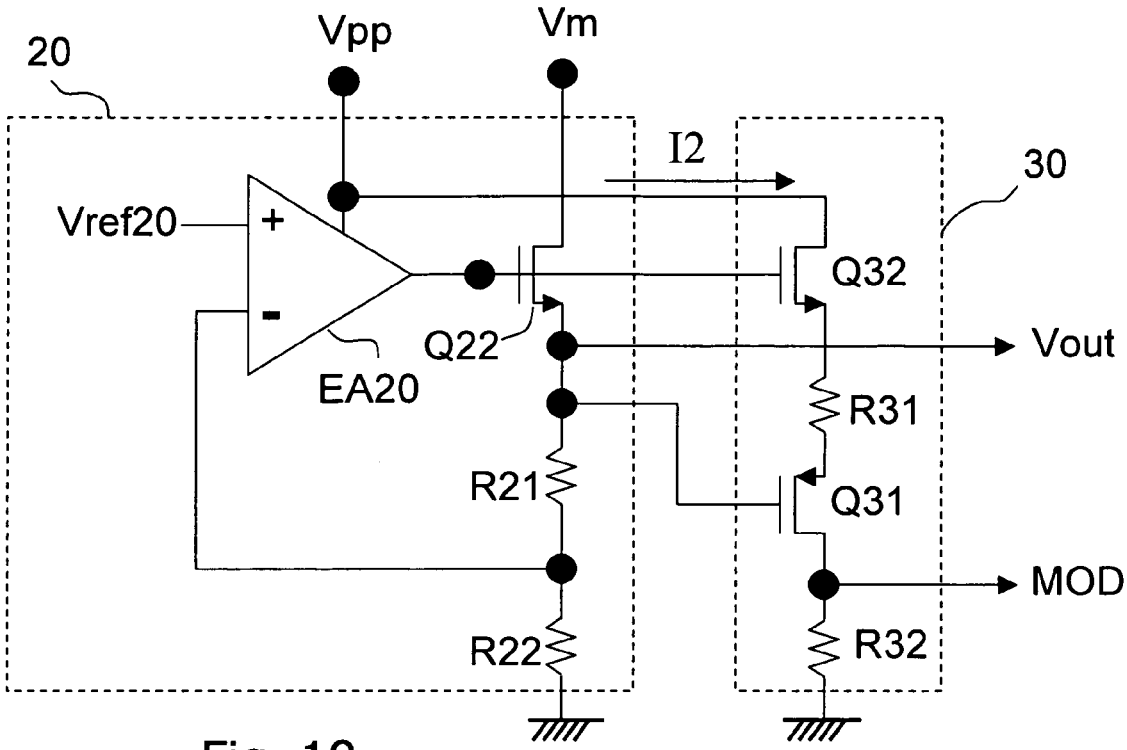
FIGS. 10 and 11 show two embodiments of the feedback control circuit, corresponding to the case wherein the power transistor of the low dropout linear regulator circuit is an NMOS transistor.
Figure 11:
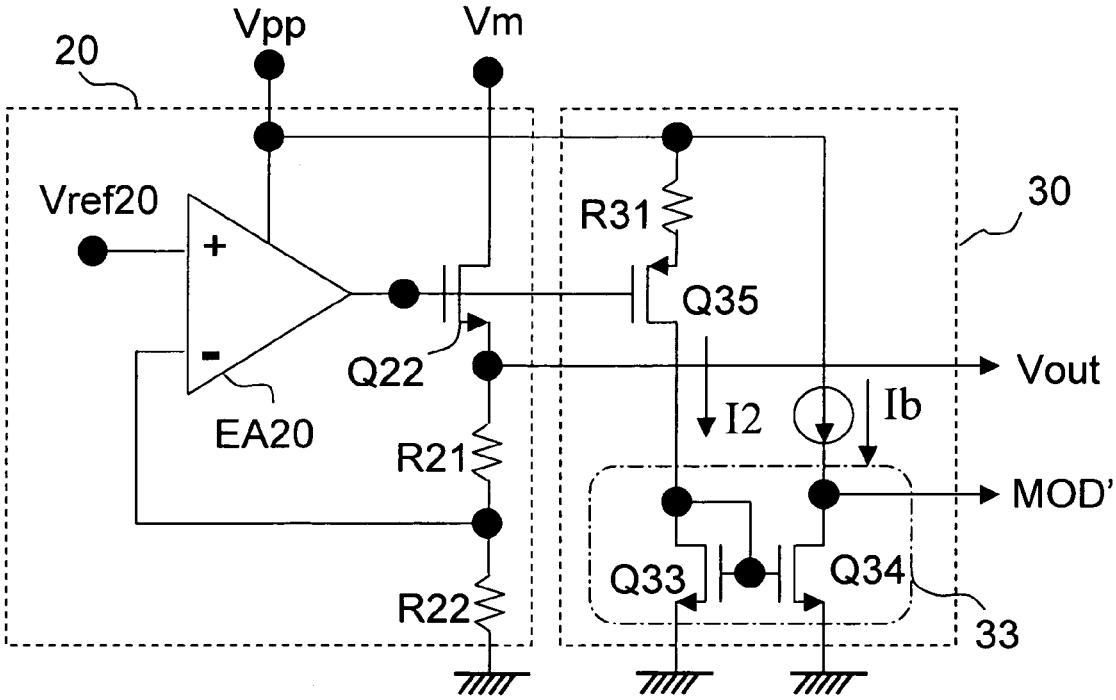

The output power transistor of the LDO circuit 20 is a PMOS transistor in the above three embodiments. It certainly can be replaced by an NMOS transistor; two corresponding embodiments are shown in FIGS. 10 and 11. FIG. 10 shows an embodiment similar to that of FIG. 7, except that the power transistor is an NMOS transistor Q22 having a gate to source voltage Vgs22. In this embodiment, the modulation signal MOD is an analog signal equal to R32*I2=R32(Vgs22−Vth31−Vth32)/R31. FIG. 11 shows an embodiment similar to that of FIG. 8, except that the power transistor is an NMOS transistor Q22, and that the NMOS transistor Q32 is replaced by a PMOS transistor Q35. In this embodiment, the modulation signal MOD' is a digital signal. When the current mirror 33 functions normally, it means that both the transistors Q35 and Q33 are conductive, and when the difference (Vpp−Vg22) between the supplied voltage Vpp and the gate voltage Vg22 of the transistor Q22 is larger than (Vth35+Ib*R31), since the current passing through the NMOS transistor Q34 is larger than Ib, the modulation signal MOD' drops to low level. On the contrary, if (Vpp−Vg22) is smaller than (Vth35+Ib*R31), since the current passing through the NMOS transistor Q34 is smaller than Ib, the modulation signal MOD' goes up to high level. Because Vpp, Vth35, Ib, and R31 are all constants, the level of the modulation signal MOD' depends on the gate voltage Vg22 of the transistor Q22:

$$MOD'=H, \text{ when } Vg22>Vpp-(Vth35+Ib*R31)$$

$$MOD'=L, \text{ when } Vg22<Vpp-(Vth35+Ib*R31)$$

The voltage Vpp supplied to the error amplifier EA20 may be the input voltage Vin, or any other voltage higher than Vm.

Figure 12:
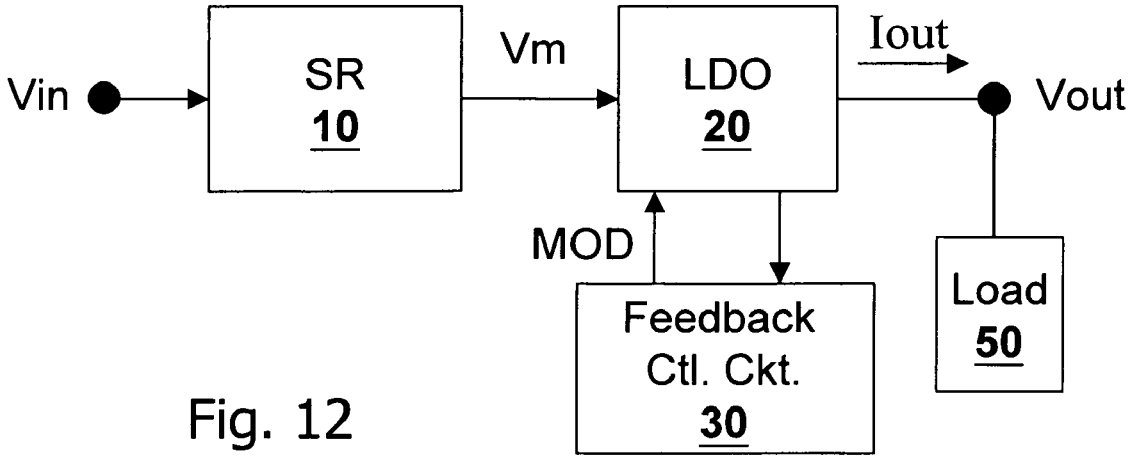
FIG. 12 is a schematic diagram showing another embodiment of the present invention.
Figure 13:
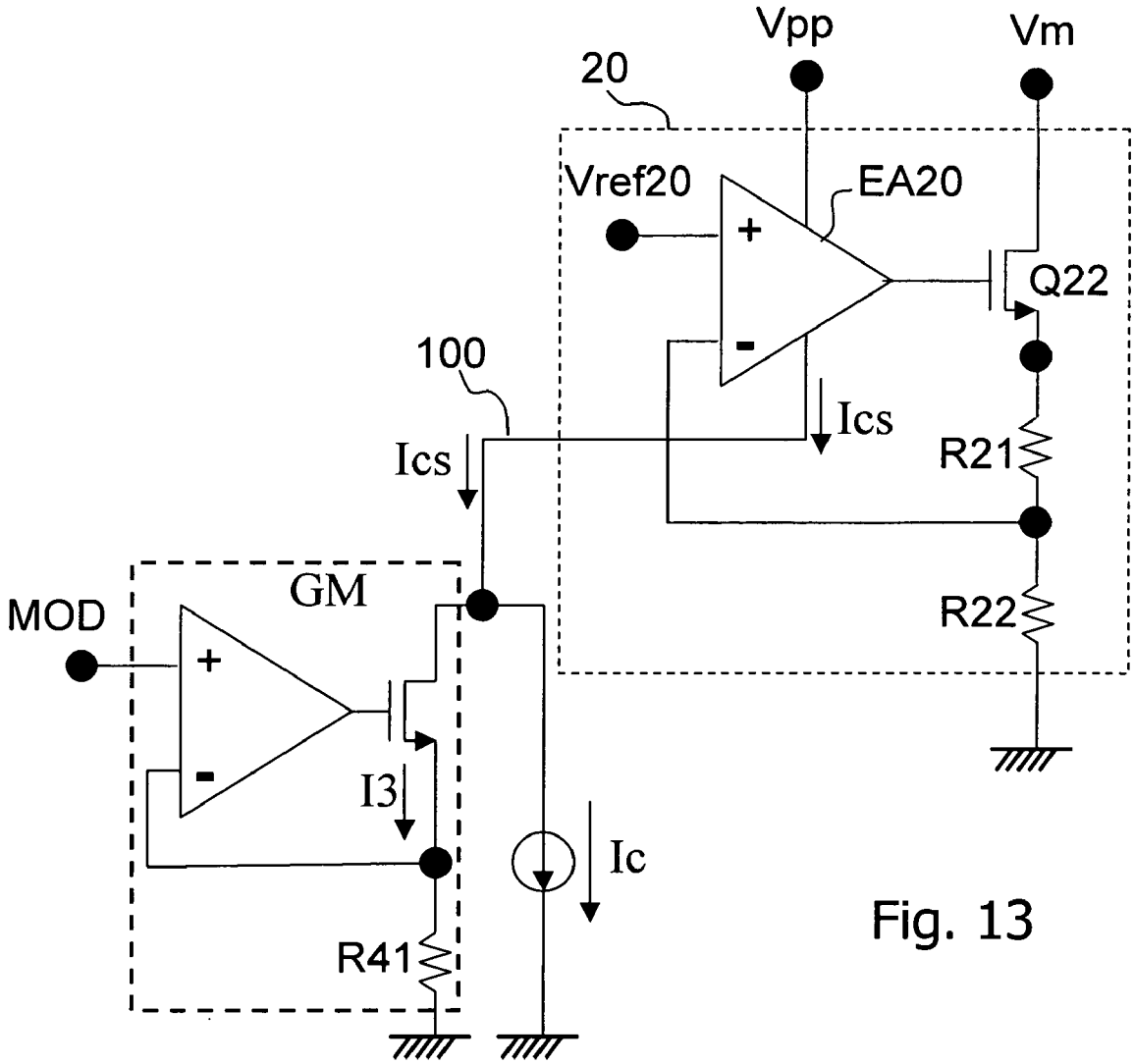
FIG. 13 illustrates an example to control the quiescent current of the low dropout linear regulator circuit according to the modulation signal MOD.

In FIGS. 4, 5A and 5B, the modulation signal MOD is fed back to control the output of the first stage switching regulator for adjusting the intermediate voltage Vm. According to FIG. 3C, under the concept of the present invention, the signal may alternatively be applied to control the quiescent current of the LDO circuit 20, as shown by FIG. 12. A more detailed embodiment is shown in FIG. 13, in which the current consumption of the error amplifier EA20 is represented by the current Ics in the path 100, which is a constant Ic if not subject to any control. According to the present invention, a transconductor GM generates a current I3 according to the modulation signal MOD; I3 is equal to the voltage of the modulation signal MOD divided by the resistance R41. The current Ics is equal to the sum of [IC+(MOD/R41)]. Thus, if MOD increases, Ics correspondingly increases; Ics is the major part of the quiescent current of the LDO circuit 20.

Figure 14A:
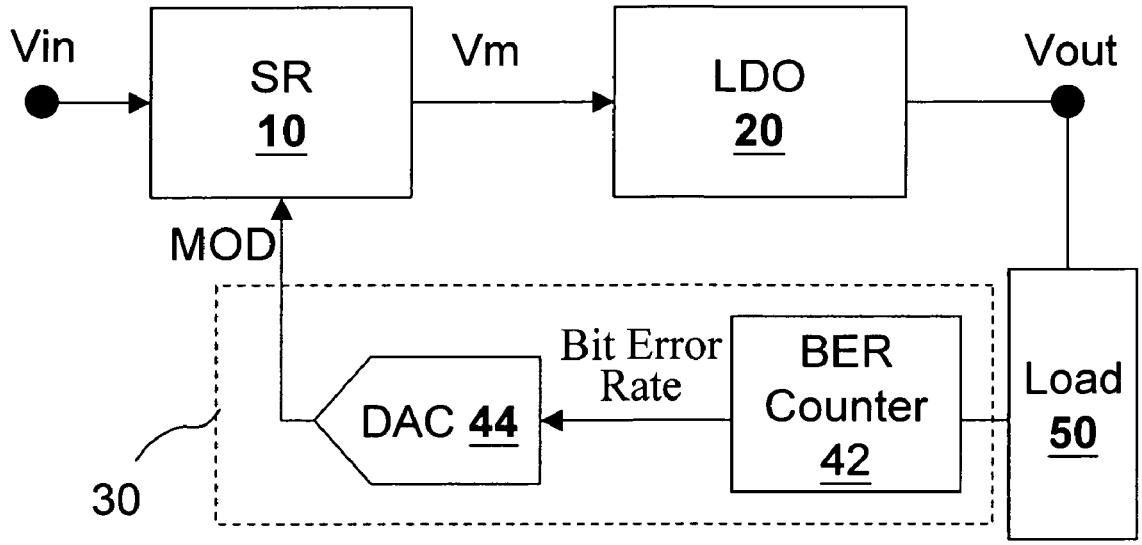
FIGS. 14A and 14B show, by way of example, how to generate the modulation signal MOD from the load circuit.
Figure 14B:
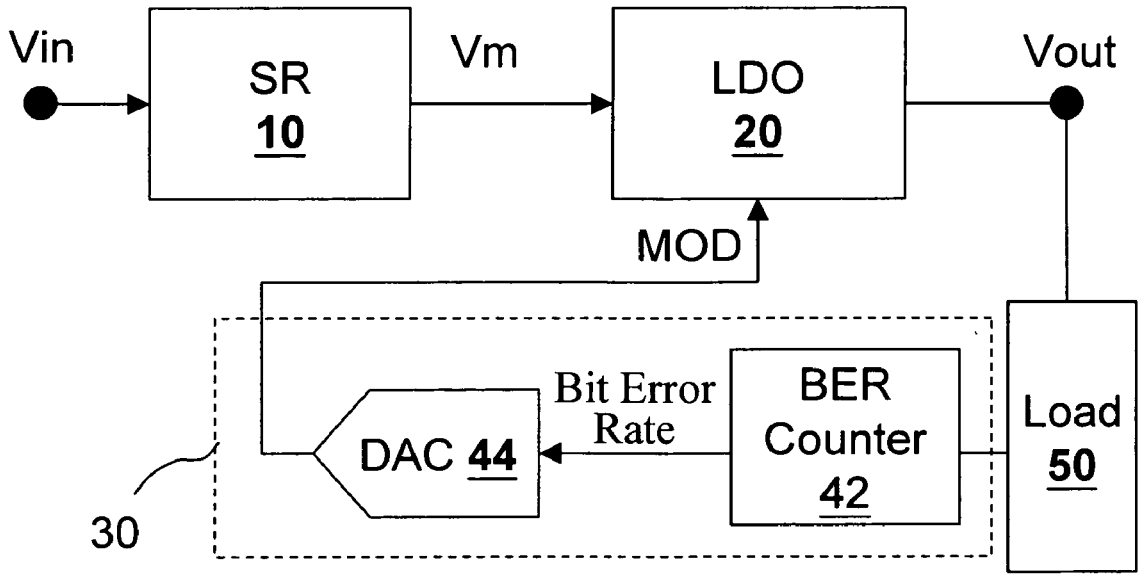

In all of the above embodiments, the modulation signal MOD is generated according to the LDO circuit 20; however, the present invention is not limited thereto. The modulation signal MOD may be generated from the load. The load circuit may be one among various kinds of circuits which can not be listed thoroughly here, and therefore this specification only describes two examples to illustrate the spirit of the present invention, as shown in FIGS. 14A and 14B. Assuming that the load circuit is sensitive to ripple noise which will cause the load circuit to malfunction occasionally, and the malfunction will generate a bit error rate (BER), a BER counter 42 counts the bit error rate and outputs it to a digital-to-analog converter (DAC) 44 to convert it to an analog signal as the modulation signal MOD. Alternatively, the bit error rate can be converted to a digital modulation signal MOD' by logic circuits. Under the teachings of the present invention, those skilled in this art can think of many ways to generate an analog modulation signal MOD or a digital modulation signal MOD' according to the characteristics of the load circuit, which should all belong to the scope of the present invention.

Figure 15A:
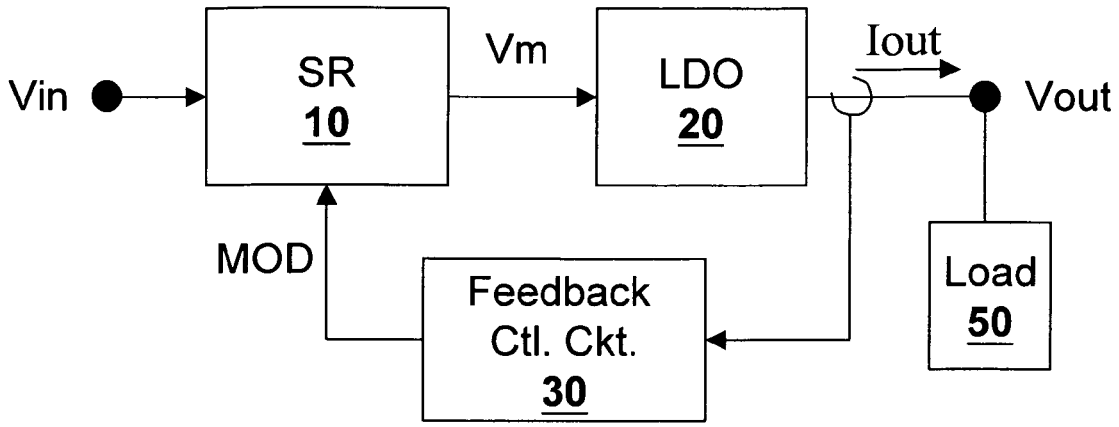
FIGS. 15A and 15B are schematic diagrams showing further embodiments of the present invention.
Figure 15B:
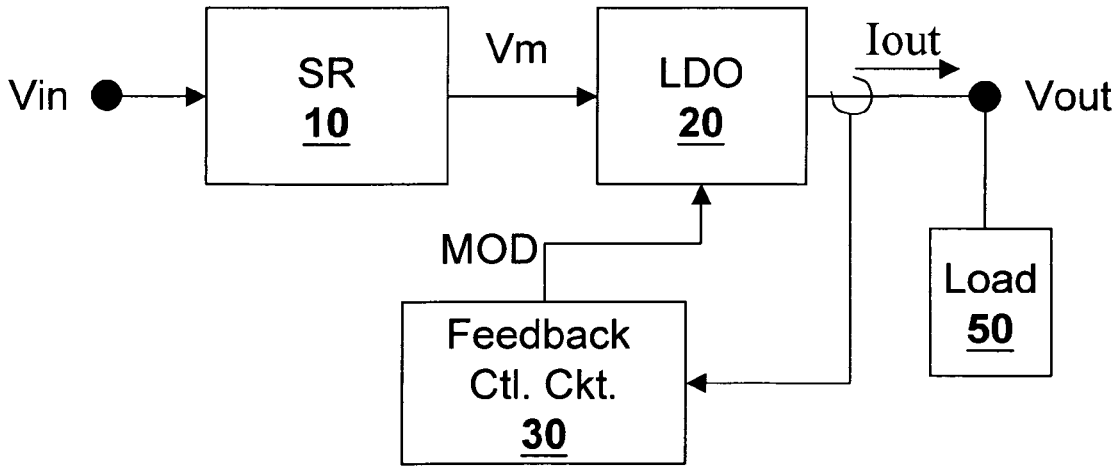

Moreover, as shown in FIGS. 15A and 15B, it is also doable to sense the current signal Iout and generate the modulation signal MOD or MOD' accordingly.

The present invention has been described in considerable detail with reference to certain preferred embodiments thereof. These embodiments are for illustrative purpose rather than for limiting the scope of the present invention. Other variations and modifications are possible and may be readily conceived by those skilled in this art. For example, one may insert circuit devices which do not affect the primary function of the circuit between two of the illustrated devices. As another example, the first stage switching regulator may be a circuit other than a buck, boost or inverter power supply circuit. As a further example, in all of the embodiments it is assumed that the load circuit requires a constant output voltage Vout. However, if the load circuit requires a variable output voltage Vout, the power conversion ratio of the first stage switching regulator or the second stage LDO circuit or both, can be adjusted by feedback control mechanism, such as by controlling an input of the error amplifier EA10 or EA20. In view of the foregoing, it is intended that the present invention cover all such modifications and variations, which should be interpreted to fall within the scope of the following claims and their equivalents.

What is claimed is:

1. A power supply, comprising:

a switching regulator circuit converting an input voltage to an intermediate voltage;

a low dropout linear regulator circuit converting the intermediate voltage to an output voltage so as to provide a load current to a load; and a feedback control circuit which increases the quiescent current of the low dropout linear regulator circuit when the load current increases, wherein the feedback control circuit includes a bit error rate counter electrically connected with the load to generate a bit error rate signal according to an abnormal condition of the load, and the bit error rate signal is converted to a modulation signal to adjust the quiescent current of the low dropout linear regulator circuit.

2. The power supply of claim 1, wherein the low dropout linear regulator circuit includes an error amplifier, and the modulation signal controls the current consumption of the error amplifier.

3. A power supply, comprising:

a switching regulator circuit converting an input voltage to an intermediate voltage;

a low dropout linear regulator circuit including a first error amplifier which controls a power transistor to convert the intermediate voltage to an output voltage so as to provide a load current to a load; and A power supply, comprising:

a switching regulator circuit converting an voltage to an intermediate voltage;

a low dropout linear regulator circuit including a first error amplifier which controls a power transistor to convert the intermediate voltage to an output voltage so as to provide a load current to a load; and a feedback control circuit which increases the voltage drop between the intermediate voltage and the output voltage when the load current increases by generating a modulation signal which is inputted to a regulation loop of the switching regulator circuit, wherein the feedback control circuit includes a bit error rate counter electrically connected with the load to generate a bit error rate signal according to an abnormal condition of the load, and the bit error rate signal is used for generating the modulation signal.

* * * * *